US008973514B2

(12) United States Patent
Hannus et al.

(10) Patent No.: US 8,973,514 B2
(45) Date of Patent: Mar. 10, 2015

(54) FLOATING SUPPORT

(75) Inventors: Henrik Hannus, Høvik (NO); Rolf Løken, Haslum (NO); Lars Laukeland, Kolsås (NO)

(73) Assignee: Aker Engineering & Technology AS, Lysaker (NO)

( * ) Notice: Subject to any disclaimer, the term of this patent is extended or adjusted under 35 U.S.C. 154(b) by 230 days.

(21) Appl. No.: 13/640,491

(22) PCT Filed: Apr. 14, 2011

(86) PCT No.: PCT/NO2011/000125

§ 371 (c)(1),
(2), (4) Date: Oct. 11, 2012

(87) PCT Pub. No.: WO2011/129706

PCT Pub. Date: Oct. 20, 2011

(65) Prior Publication Data

US 2013/0032075 A1 Feb. 7, 2013

(30) Foreign Application Priority Data

Apr. 15, 2010 (NO) ..... 20100538

(51) Int. Cl.
*B63B 35/44* (2006.01)
*B63B 39/00* (2006.01)

(52) U.S. Cl.
CPC ..... *B63B 35/4406* (2013.01); *B63B 39/00* (2013.01); *B63B 2035/442* (2013.01)
USPC ..... 114/264; 405/195.1

(58) Field of Classification Search
USPC ..... 405/195, 203, 205; 114/264
See application file for complete search history.

(56) References Cited

U.S. PATENT DOCUMENTS 3,408,821 A * 11/1968 Redshaw ..... 405/200
4,048,943 A * 9/1977 Gerwick, Jr. ..... 114/256
4,498,412 A * 2/1985 Liden ..... 114/264
4,630,968 A * 12/1986 Berthet et al. ..... 405/195.1
4,685,833 A * 8/1987 Iwamoto ..... 405/195.1
4,702,321 A * 10/1987 Horton ..... 166/350
4,913,238 A * 4/1990 Danazcko et al. ..... 405/223.1

(Continued)

FOREIGN PATENT DOCUMENTS

GB 2 025 330 A 1/1980
GB 2 328 408 A 2/1999

(Continued)

OTHER PUBLICATIONS

International Search Report issued in PCT/NO11/000125 mailed Oct. 6, 2011 (2 pages).

(Continued)

*Primary Examiner* — Lars A Olson
*Assistant Examiner* — Javon Hayes
(74) *Attorney, Agent, or Firm* — Osha Liang LLP

(57) ABSTRACT

A support of deep caisson type having a longitudinal axis, for floating installation in a body of water and provided with mooring lines for anchoring to a seabed, has a lower portion in the body of water having a weight element, an upper portion that supports a platform above a water surface, and an extended portion in an area between the upper portion and the lower portion. The extended portion has one or more internal storage chambers and one or more ballast chambers. The storage chambers are arranged closer to the longitudinal axis than the ballast chambers.

19 Claims, 6 Drawing Sheets

(56) References Cited

U.S. PATENT DOCUMENTS

| | | | | |
|---|---|---|---|---|
| 4,995,762 | A * | 2/1991 | Goldman | 405/195.1 |
| 5,558,467 | A * | 9/1996 | Horton | 405/195.1 |
| 5,707,178 | A * | 1/1998 | Srinivasan | 405/223.1 |
| 5,722,797 | A * | 3/1998 | Horton, III | 405/224 |
| 6,161,620 | A * | 12/2000 | Cox et al. | 166/367 |
| 6,210,075 | B1 * | 4/2001 | Korloo | 405/206 |
| 6,309,141 | B1 * | 10/2001 | Cox et al. | 405/224 |
| 6,336,421 | B1 * | 1/2002 | Fitzgerald et al. | 114/264 |
| 6,869,251 | B2 * | 3/2005 | Zou et al. | 405/205 |
| 7,096,957 | B2 * | 8/2006 | Nish et al. | 166/367 |
| 7,565,877 | B2 * | 7/2009 | Sablok et al. | 114/264 |
| 7,934,462 | B2 * | 5/2011 | Mansour et al. | 114/264 |
| 8,387,550 | B2 * | 3/2013 | Mansour | 114/265 |
| 2003/0099516 | A1 * | 5/2003 | Chow | 405/195.1 |
| 2013/0032075 | A1 * | 2/2013 | Hannus et al. | 114/264 |

FOREIGN PATENT DOCUMENTS

| | | | |
|---|---|---|---|
| NO | 316267 | B1 | 1/2004 |
| WO | 97/29948 | A1 | 8/1997 |
| WO | 98/29299 | A1 | 7/1998 |
| WO | 2005/113329 | A1 | 12/2005 |

OTHER PUBLICATIONS

International Preliminary Report on Patentability with Response to Written Opinion issued in PCT/NO2011/000125 dated Jun. 26, 2012 (8 pages).

Norwegian Search Report issued in Norwegian Application No. 20100538 dated Dec. 13, 2011 (1 page).

* cited by examiner

FLOATING SUPPORT

BACKGROUND

1. Field of the Invention

The invention relates to an independent floating caisson with a relatively deep draft, known in the business as "deep caisson" and "spar", especially for use as a support for platforms employed in connection with recovery of hydrocarbons from subsea formations.

2. Description of Related Art

There are a number of types of floating platform, such as for example drilling and production ships, tension leg platforms (TLPs), semi-submersible platforms (semi-submersibles) and so-called spar platforms.

An example of a tension leg platform (TLP) is disclosed in U.S. Pat. No. 4,685,833 (Iwamoto). The publication describes a system for use on an isolated well on the seabed, comprising a basis unit 11 on the seabed, a buoyancy body 13 and a prestressed riser arrangement 12. The riser arrangement anchors the buoyancy body by means of pre-tensioning to the basis unit.

Another example of a tension leg platform (TLP) is disclosed in NO 316267 (Børseth), describing a method and a device for providing a stabilising moment for a TLP platform which is attached and anchored to the seabed.

U.S. Pat. No. 3,408,821 (Redshaw) describes a floating, ballastable column.

A spar platform has a support which substantially comprises a relatively long, columnar structure floating in an approximately vertical position in the water, with one or more buoyancy chambers in an upper part and a stabilising weight in the spar support's lower part. An upper part of the spar support extends above the water line where it supports a platform with, e.g. a drill deck, processing plant or the like. The spar support's relatively slim, elongate shape and relatively deep draft permit this type of support to tackle heave motions better (i.e. longer heave natural periods) than other types of floating platform.

A spar support of this type is described in patent publication U.S. Pat. No. 4,702,321 (Horton). Further examples of spar type supports in different variants are described in patent publications WO 2005/113329 (Horton), U.S. Pat. No. 5,722,797 (Horton), U.S. Pat. No. 4,630,968 (Berthet et al.), U.S. Pat. No. 6,309,141 (Cox et al.), WO 98/29299 (Allen et al.), and U.S. Pat. No. 6,161,620 (Cox et al.).

A platform with a spar support is a well-established structure, employed substantially in maritime areas with relatively low wave periods, such as off Malaysia and in the Mexican Gulf. In these waters waves are encountered with a typical period (Tp) of 13-15 s for a 100-year state.

A design restriction for the spar support is excitation of heave motion at resonance, and the combination of heave and roll/pitch motions for waves with a long period. In maritime areas such as, e.g. the North Atlantic, the wave conditions are considerably more challenging than in the Mexican Gulf, and floating supports designed for the Norwegian Sea have to be designed for wave periods (Tp) of between 15 and 19 s in a 100-year state.

When the spar support's heave natural period is excited by waves, it will produce unacceptable motions. Another resonance lies in the coupling of heave and roll/pitch motions, often referred to as Mathieu instability or parametric excitation. This effect occurs at different sum frequencies of heave and roll/pitch.

Thus there is a need for a platform support of the spar type which is better suited for installation in maritime areas with long waves (i.e. high wave periods) than is the case with the known spar supports.

SUMMARY

Thus a support of the deep caisson type is provided with a longitudinal axis for floating installation in a body of water, with a lower portion in the body of water and an upper portion for support of a platform above a water surface, characterised in that the support further comprises an extended portion in an area between the upper portion and the lower portion, whereby the support's heave natural period is increased.

The extended portion according to one or more embodiments of the present invention comprises one or more internal storage chambers and one or more ballast chambers. In one or more embodiments of the present invention, the storage chambers are arranged inside, i.e. closer to the support's longitudinal axis than, the ballast chambers.

In one or more embodiments of the present invention, the transitions between the extended portion and the upper and lower portions respectively are stepped, with protruding transitions between the portions. In one or more embodiments of the present invention, the extended portion is attached to the upper portion and the lower portion respectively via respective transitions comprising shear plates, whereby the forces between the portions are transmitted as shear forces.

In one or more embodiments of the present invention, the transitions between the extended portion and the upper and lower portions respectively are bevelled, with bevelled transitions between the portions.

The upper portion has a dimension $d_a$ perpendicular to the support's longitudinal axis, the extended portion has a dimension $d_b$ perpendicular to the support's longitudinal axis, and the lower portion has a dimension $d_c$ perpendicular to the support's longitudinal axis, and $d_b>d_a$ and $d_b>d_c$. In one or more embodiments of the present invention, $d_a \geq d_c$.

In one or more embodiments of the present invention, the said portions comprise circular cross sections. In one or more embodiments of the present invention, the said portions comprise rectangular or square cross sections.

The extended portion is located below the water surface in which the support is installed in the body of water.

One or more embodiments of the present invention involves an alteration of the geometry on the upper part of the underwater hull, resulting in an increase in the diameter of a section under water relative to the rest of the hull. This provides increased mass without increasing the heave rigidity, but the hull's buoyancy increases and heave mass increases, and thereby also the heave period. The device according to one or more embodiments of the invention increases the platform's heave natural period, thereby permitting the use of spar platforms in the North Atlantic. The hull's buoyancy and diameter in the water line are reduced, resulting in a reduction in the water line rigidity, which also helps to increase the heave period.

BRIEF DESCRIPTION OF THE FIGURES

These and other embodiments of the invention will be explained in the following description, presented as non-limiting examples, with reference to the accompanying schematic drawings, in which.

DETAILED DESCRIPTION

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 4:
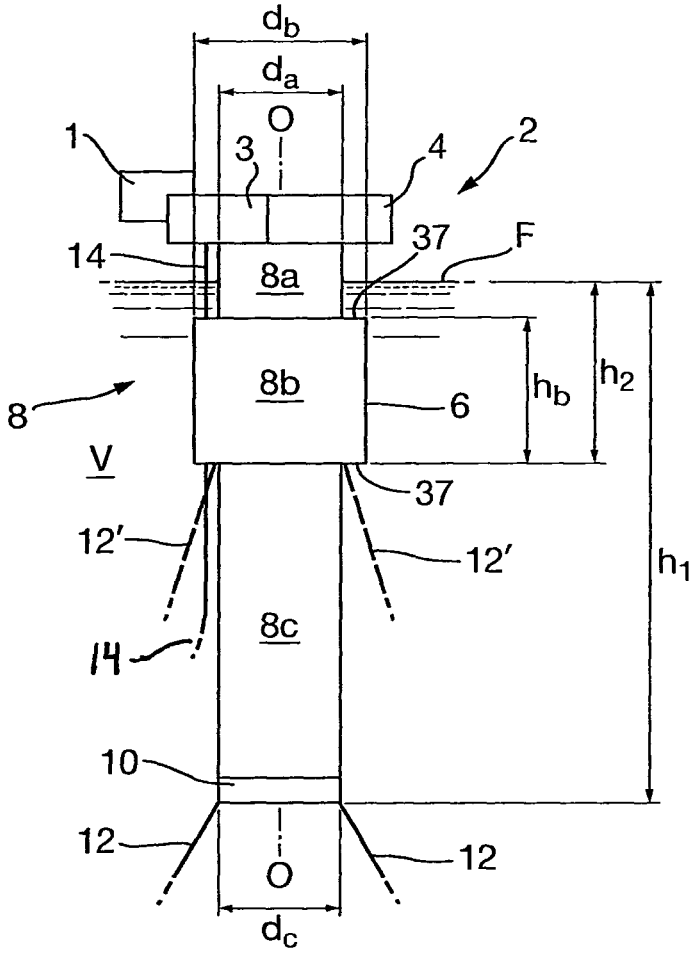
FIG. 4 is a side view of a support according to one or more embodiments of the invention.

With reference to FIG. 4, the support 8 according to one or more embodiments of the invention comprises an upper portion 8*a*, a lower portion 8*c*, provided with a weight element 10, and an intermediate extended portion 8*b*. The support comprises buoyancy elements and is floating in a body of water V, and above the water surface F supports a platform 2, which may comprise known units such as a drilling installation, processing plant 4, auxiliary systems 3 and living quarters 1.

The support may be anchored to the seabed (not shown) by means of mooring lines 12 etc. of a known type and in a known manner. Alternative or additional mooring lines 12' are indicated by dotted lines.

Figure 5:
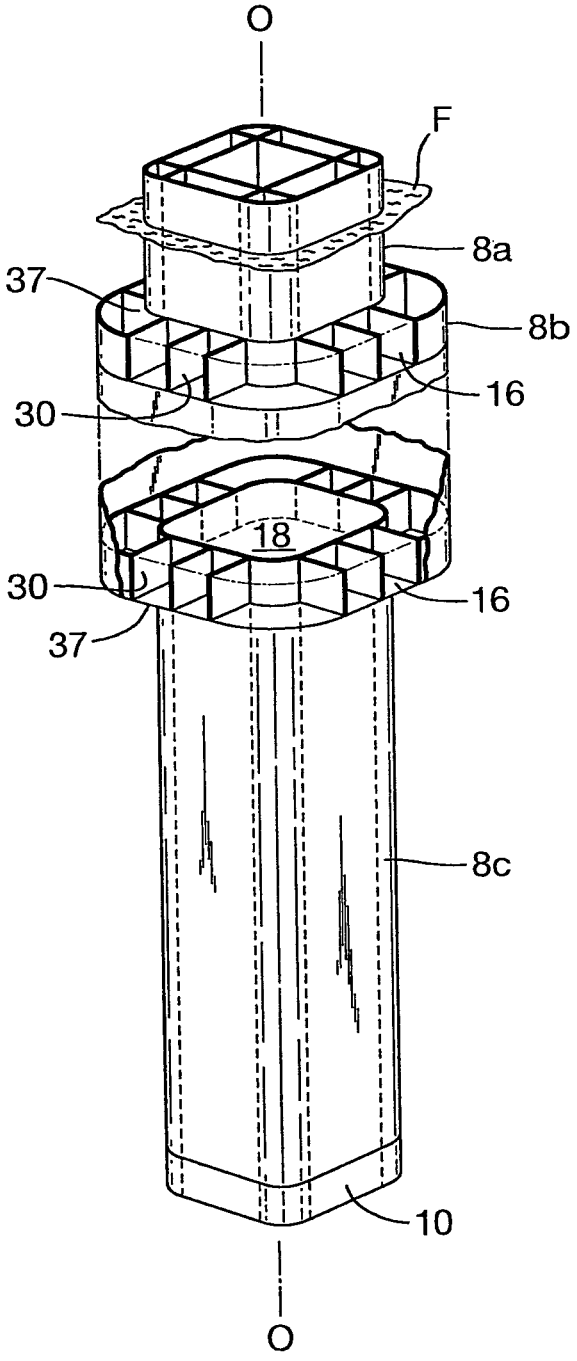
FIG. 5 is a perspective and partly intersected view of a support according to one or more embodiments of the invention.

The upper portion 8*a* has a first width $d_a$, the extended portion 8*b* has a second width $d_b$, and the lower portion 8*c* has a third width $d_c$. In this context, the term "width" refers to a dimension perpendicular to the support's longitudinal axis, as illustrated in the figures. In one or more of the embodiments illustrated in FIGS. 1-4, the support has a circular cross section, so that these said widths are diameters. Moreover, as illustrated in FIGS. 2*a*, 2*b* and 5, the support according to one or more embodiments of the invention may have a circular cross section or a square cross section, and the invention, furthermore, is not limited to these cross sectional shapes.

FIG. 4 shows how the upper portion 8*a* has the same diameter as the lower portion 8*c*, i.e. $d_a=d_c$, and how the extended portion 8*b* has a diameter which is larger than both the upper and the lower portion, i.e. $d_b>d_a$ and $d_c$. Thus it is possible to insert riser 14 or a similar elongate element from installations on the seabed (not shown) into the extended portion's 8*b* lower edge via a penetration and up to the platform 2 along the outside of the upper portion 8*a*, as illustrated schematically in FIG. 4. In this variant the upper portion 8*a* and the lower portion 8*c* may be interconnected and in practice be a through-going structure through the extended portion 8*b*, thereby giving a direct strength connection between the support's upper and lower ends.

Figure 1:
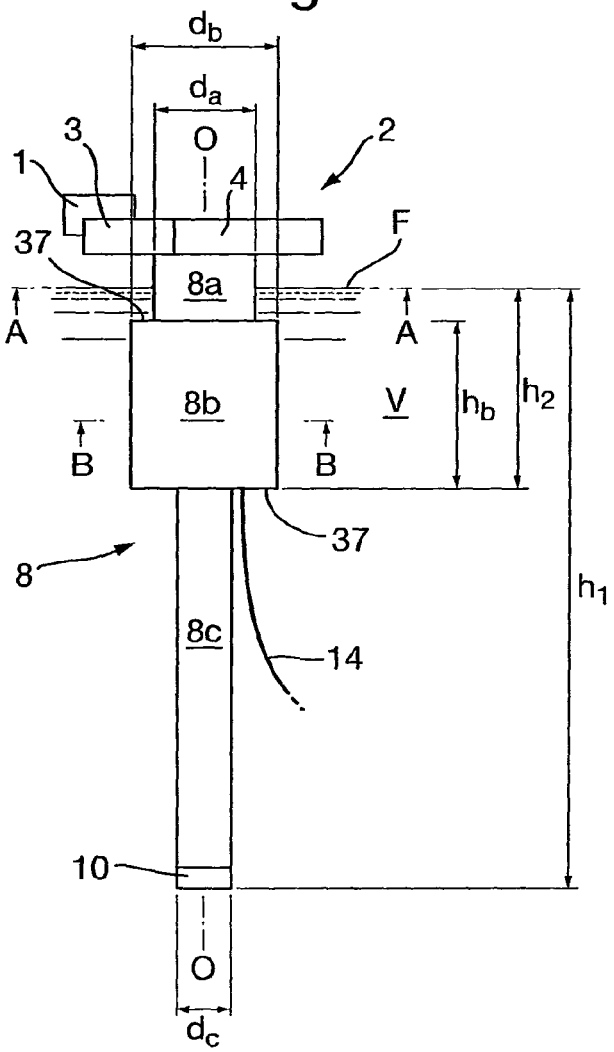
FIG. 1 is a side view of a support according to one or more embodiments of the invention.
Figure 3:
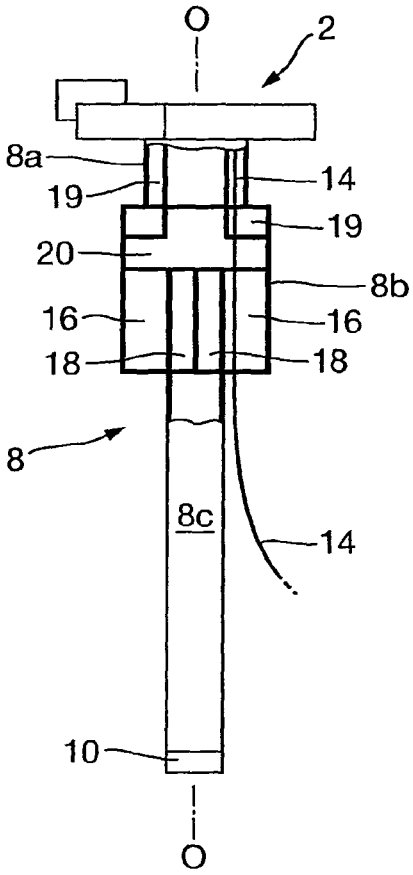
FIG. 3 is a sectional view along the support's longitudinal axis, as indicated by lines C-C in FIGS. 2*a* and 2*b*.
Figure 2A:
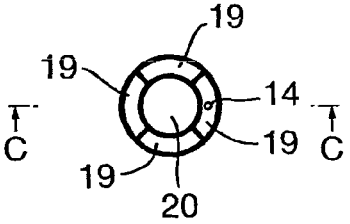
FIG. 2*a* is a sectional view along line A-A in FIG. 1.
Figure 2B:
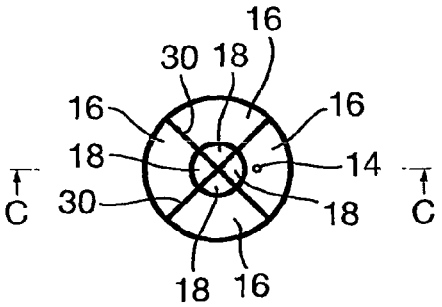
FIG. 2*b* is a sectional view along line B-B in FIG. 1.

FIG. 1 illustrates a variant of the support according to one or more embodiments of the invention where the upper portion 8*a* has a larger diameter $d_a$ than the lower portion's 8*c* diameter $d_c$. This permits the riser 14 to also be inserted internally in the upper portion 8*a*, in addition to internally in the extended portion 8*b* as mentioned above. This is illustrated in the sectional views in FIGS. 2*a*, 2*b* and 3 et al. These figures also show how the extended portion 8*b* contains internal tanks 18, which may be employed, e.g. for oil storage. For reasons of safety these tanks 18 are arranged centrally in the cylinder, with ballast tanks 16 radially outside. The storage tank(s) may be placed as low as practically possible in the extended portion 8*b* in order to make a positive contribution to the platform's stability.

The transitions 37 between the three portions 8*a, b, c* are illustrated in FIGS. 1-5 as stepped transitions 37. This is advantageous from the product engineering and cost point of view. In order to be able to withstand such a sudden design change and to support the loads between the portions, the transitions include bulkheads 30 extending between the upper portion 8*a* and the extended portion 8*b*, and between the lower portion 8*c* and the extended portion 8*b*. For a circular cross section, see FIG. 2*b*, the bulkheads 30 are radial.

The bulkheads 30 act as shear plates, since they transmit the forces in the transitions as shear forces.

Figure 6:
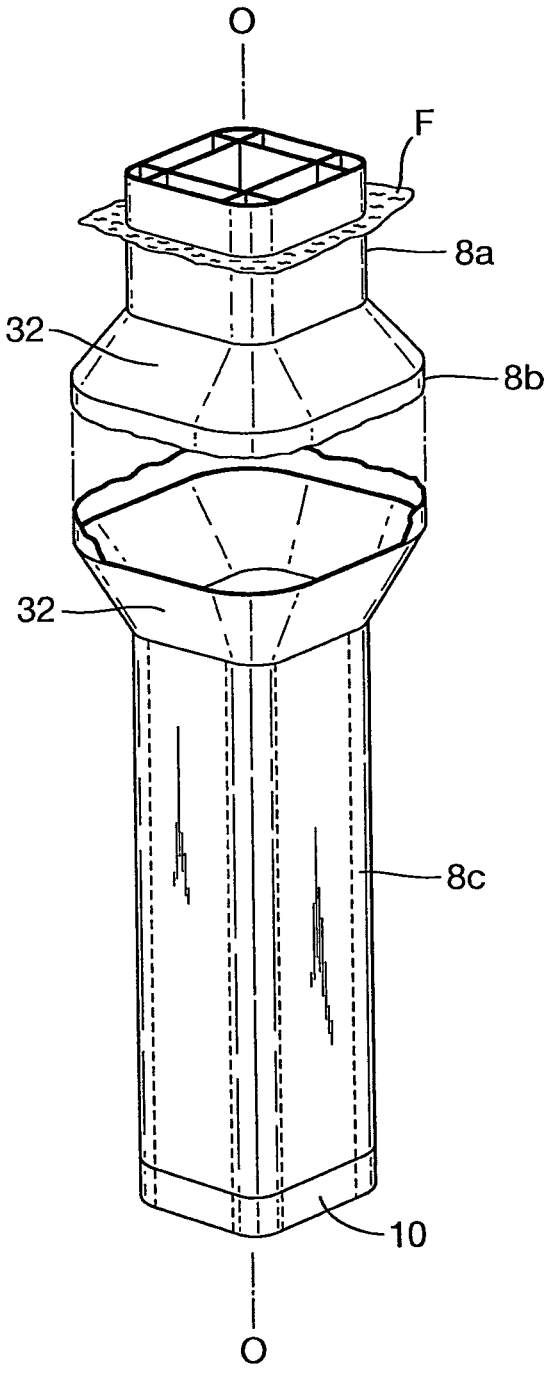
FIG. 6 is a perspective and partly intersected view of a support according to one or more embodiments of the invention.

FIG. 6 illustrates a support according to one or more embodiments of the invention where the transitions between the upper portion 8*a* and the extended portion 8*b*, and between the extended portion 8*b* and the lower portion 8*c* are provided as bevelled transitions 32. Such bevelled portions 32 create softer transitions between the portions and can replace the internal shear plates 30 mentioned above. However, one or more embodiments of the present invention may also comprise the above-mentioned internal storage tanks 18 and buoyancy chamber 20, even though these are not shown in FIG. 6.

Figure 7:
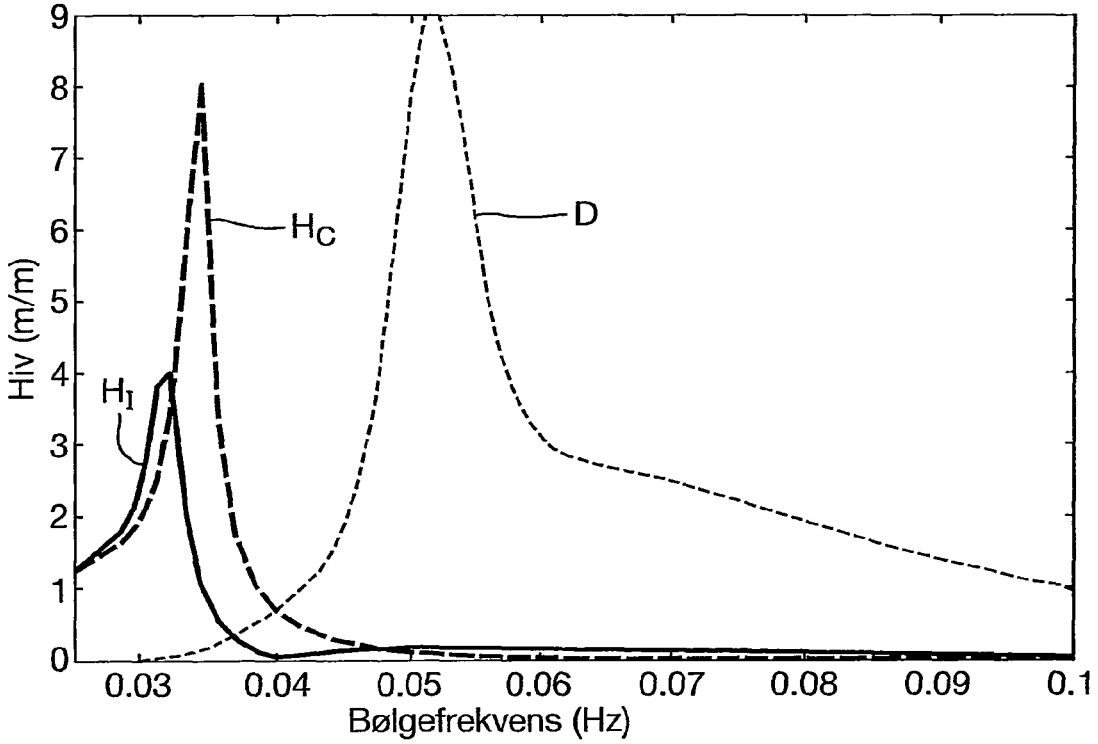
FIG. 7 illustrates heave response RAO (Response Amplitude Operator) as a function of wave frequency for a spar support according to a conventional device and for the spar support according to one or more embodiments of the invention, compared with a representative wave spectrum.
Figure 8:
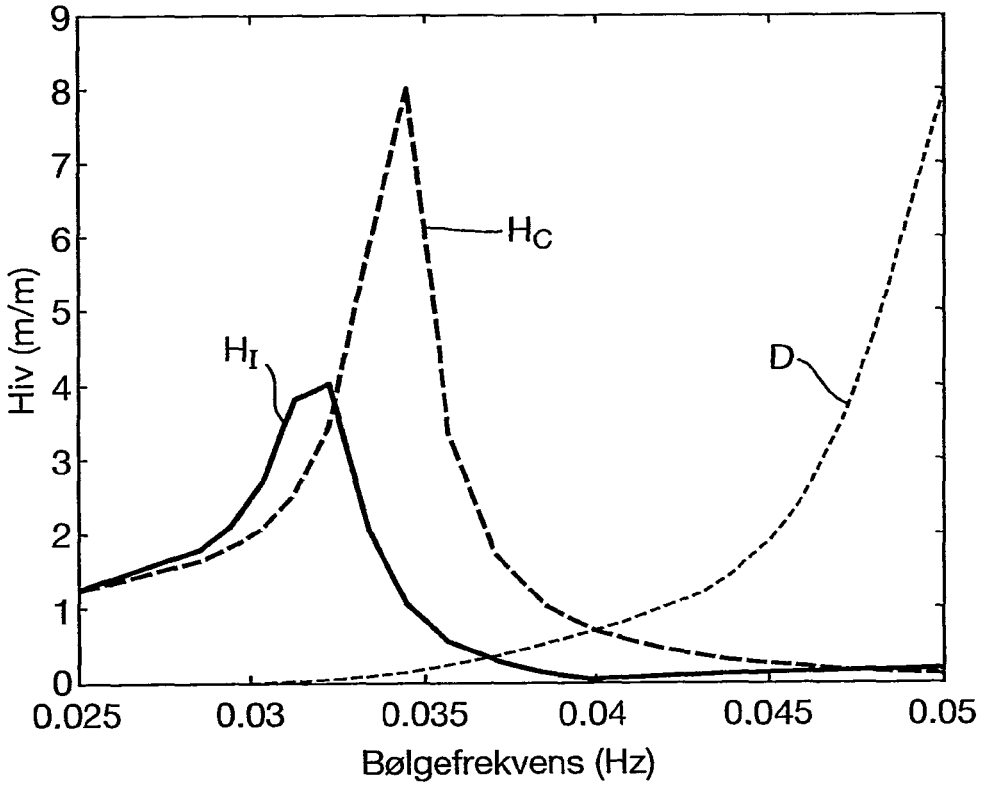
FIG. 8 illustrates heave response RAO for a spar support according to a conventional device and for the spar support according to one or more embodiments of the invention, compared with a representative wave spectrum, for wave frequencies round heave resonance.

As an example, a support according to one or more embodiments of the invention with a load-bearing capacity of 20,000 tons and an oil/condensation storage tank 18 with a volume of 50,000 barrels, may have the following parameters (see FIGS. 1, 3 and 4 which are schematic and not on the correct scale):

$d_a=d_c=30$ meters $d_b=40$ meters $h_1=170$ meters $h_2=80$ meters $h_d=50$ meters Improvement in heave response is illustrated by comparing motions with a classic spar in typical design waves for the Norwegian Sea. The heave motion's RAOs (Response Amplitude Operator) are illustrated in FIG. 7, showing where the wave energy is for a typical design wave in the Norwegian Sea. The dotted curve marked Hc indicates a classic spar support, the continuous curve marked $H_1$ indicates the support according to one or more embodiments of the invention, while the dotted curve marked D indicates the design wave spectrum. The curves show that both the concepts will have little response excited by the dominating wave frequencies. Concerns with the classic spar support arises in the area where heave resonance starts and it is still noticeable with wave energy. This area is illustrated in FIG. 8.

Figure 9:
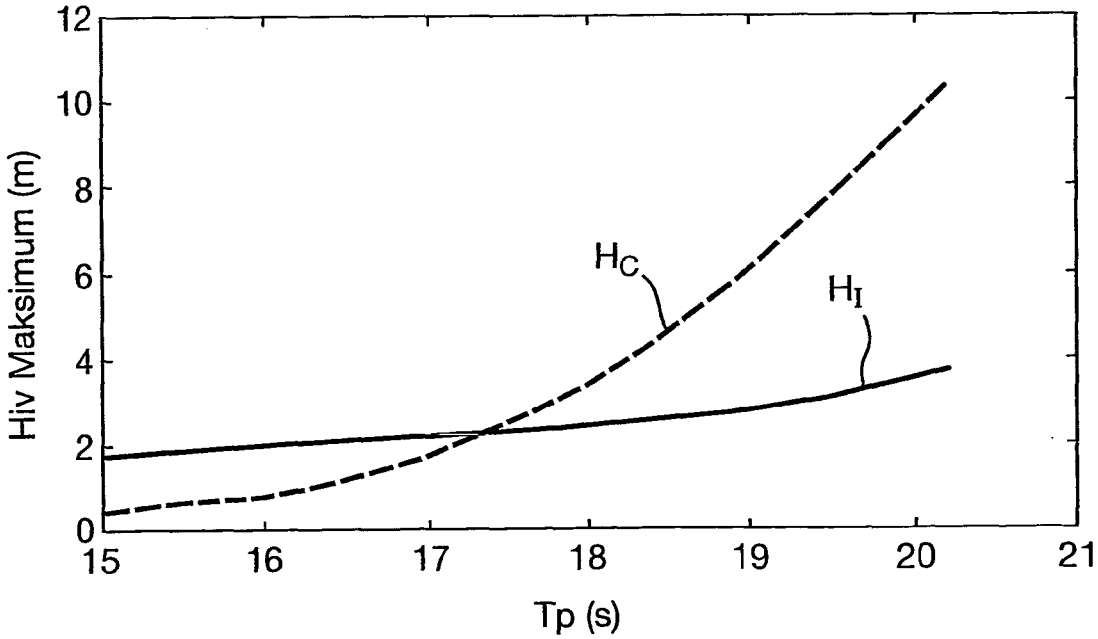
FIG. 9 illustrates extreme values for heave response for sea states along a typical 100-year contour in the Norwegian Sea.

Comparison of resulting heave motion for relevant wave periods, represented by sea states along the 100-year contour line in the Norwegian Sea is illustrated in FIG. 9. The classic spar support shows great sensitivity to wave period due to excitation of heave resonance at higher wave periods. The spar support according to one or more embodiments of the invention is much less sensitive to wave period, and it is excitation round the top of the wave spectrum which will dominate, and not heave resonance, with the result that this support is much less exposed to the Mathieu instability or parametric excitation between heave and pitch. With its low heave damping level, it is highly probable that a spar support of the known type will be unstable in such waves.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A deep caisson support having a longitudinal axis, for floating installation in a body of water and provided with mooring lines for anchoring to a seabed, the support comprising: a lower portion in the body of water having a weight element; an upper portion that supports a platform above a water surface; and an extended portion in an area between the upper portion and the lower portion, wherein the extended portion comprises one or more internal storage chambers and one or more ballast chambers, and wherein the storage chambers are arranged closer to the longitudinal axis than the ballast chambers, and wherein the extended portion is attached to the upper portion and the lower portion respectively via respective transitions comprising shear plates, whereby the forces between the portions are transmitted as shear forces.

2. The deep caisson support according to claim 1, wherein the storage chambers are storage tanks for oil.

3. The deep caisson support according to claim 1, wherein transitions between the extended portion and the upper and lower portions respectively are stepped, with protruding transitions between the portions.

4. The deep caisson support according to claim 1, wherein the transitions between the extended portion and the upper and lower portions respectively are bevelled, with bevelled transitions between the portions.

5. The deep caisson support according to claim 1, wherein the upper portion has a dimension da perpendicular to the support's longitudinal axis, the extended portion has a dimension db perpendicular to the support's longitudinal axis, and the lower portion has a dimension dc perpendicular to the support's longitudinal axis, and wherein db>da and db>dc.

6. The deep caisson support according to claim 5, wherein da≥dc.

7. The deep caisson support according to claim 5, wherein db is (4/3)*da.

8. The deep caisson support according to claim 1, wherein the lower portion, the upper portion, and the extended portion comprise circular cross sections.

9. The deep caisson support according to claim 1, wherein the lower portion, the upper portion, and the extended portion comprise rectangular or square cross sections.

10. The deep caisson support according to claim 1, wherein the extended portion is located below the water surface in which the support is installed in the body of water.

11. The deep caisson support according to claim 6, wherein db is (4/3)*da.

12. The deep caisson support according to claim 2, wherein the transitions between the extended portion and the upper and lower portions respectively are stepped, with protruding transitions between the portions.

13. The deep caisson support according to claim 2, wherein the extended portion is attached to the upper portion and the lower portion respectively via respective transitions comprising shear plates, whereby the forces between the portions are transmitted as shear forces.

14. The deep caisson support according to claim 3, wherein the extended portion is attached to the upper portion and the lower portion respectively via respective transitions comprising shear plates, whereby the forces between the portions are transmitted as shear forces.

15. The deep caisson support according to claim 12, wherein the extended portion is attached to the upper portion and the lower portion respectively via respective transitions comprising shear plates, whereby the forces between the portions are transmitted as shear forces.

16. The deep caisson support according to claim 2, wherein the transitions between the extended portion and the upper and lower portions respectively are bevelled, with bevelled transitions between the portions.

17. The deep caisson support according to claim 3, wherein the transitions between the extended portion and the upper and lower portions respectively are bevelled, with bevelled transitions between the portions.

18. The deep caisson support according to claim 3, wherein the transitions between the extended portion and the upper and lower portions respectively are beveled, with beveled transitions between the portions.

19. The deep caisson support according to claim 12, wherein the transitions between the extended portion and the upper and lower portions respectively are bevelled, with bevelled transitions between the portions.

* * * * *